United States Patent [19]

Aberegg

[11] Patent Number: 4,597,497

[45] Date of Patent: Jul. 1, 1986

[54] HOIST WITH REDUNDANT SAFETY FEATURES

[75] Inventor: Richard E. Aberegg, Alliance, Ohio

[73] Assignee: Koehring Morgan, Hanover, N.H.

[21] Appl. No.: 331,151

[22] Filed: Dec. 16, 1981

[51] Int. Cl.[4] ..... B66C 13/06; B66C 13/16; B66C 17/00; B66C 11/02

[52] U.S. Cl. ..... 212/147; 212/149; 212/153; 212/159; 212/205; 212/216

[58] Field of Search ..... 212/171, 205, 146–147, 212/225–226, 209, 212, 149, 153; 254/266, 270, 269, 274–275, 278–279

[56] References Cited

U.S. PATENT DOCUMENTS

| | | | |
|---|---|---|---|
| 2,609,181 | 9/1952 | Jaeschke | 254/276 |
| 3,786,935 | 1/1974 | Vlazny et al. | 212/146 |
| 3,841,495 | 10/1974 | Dronick et al. | 212/205 |
| 3,866,200 | 2/1975 | Paredes et al. | 212/153 |
| 3,973,679 | 8/1976 | Hass et al. | 212/205 |
| 4,069,921 | 1/1978 | Raugulis et al. | 212/205 |
| 4,073,476 | 2/1978 | Frank | 254/184 |
| 4,175,727 | 11/1979 | Clarke | 254/173 |
| 4,177,973 | 12/1979 | Miller et al. | 254/173 |

FOREIGN PATENT DOCUMENTS

| | | | |
|---|---|---|---|
| 1073709 | 1/1960 | Fed. Rep. of Germany | 254/269 |
| 436790 | 12/1974 | U.S.S.R. | 254/273 |
| 582176 | 11/1977 | U.S.S.R. | 212/147 |
| 686981 | 9/1979 | U.S.S.R. | 212/205 |

*Primary Examiner*—Galen L. Barefoot

*Assistant Examiner*—R. B. Johnson

*Attorney, Agent, or Firm*—Renner, Otto, Boisselle & Lyon

[57] ABSTRACT

A hoist 10 with redundant safety features comprising: a hoist support frame; a lifting drum 14 mounted on the hoist support frame; a load block assembly 28; an equalizer assembly 24 mounted on the hoist support frame; the load block assembly 28 being suspended by a first set of ropefalls 30 and 36 and a second set of ropefalls 32 and 34, each of the ropefalls having one end secured to lifting drum 14 and the other end secured to equalizer assembly 24, each of the sets of ropefalls having sufficient load bearing capacity to carry the load carried by the other set of ropefalls in addition to its own load; each of the ropefalls having first sections extending from lifting drum 14 to load block assembly 28 and second sections extending from load block assembly 28 to equalizer assembly 24, each of the first sections being positioned in a substantially common plane with each other and each of the second sections being positioned in another substantially common plane with each other; equalizer assembly 24 including a first load balancing mechanism for balancing the load carried by the first set of ropefalls, a second load balancing mechanism for balancing the load carried by the second set of ropefalls, and a load sensor for generating an electrical signal in response to variations in the load carried by the first or second second set of ropefalls. A trolley 12 for supporting hoist 10, and an auxiliary hoist 56 associated with trolley 12 is also disclosed.

4 Claims, 7 Drawing Figures

HOIST WITH REDUNDANT SAFETY FEATURES

TECHNICAL FIELD

This invention relates generally to hoists and, more particularly, to hoists that are particularly adapted for hoisting critical loads such as, for example, nuclear waste casks. Specifically, this invention relates to hoists that include redundant safety features such that failure of a load-supporting element of the hoist is compensated for to permit the hoist to maintain control over the load despite failure of such element.

BACKGROUND OF THE INVENTION

Hoists have over a number of years in a variety of applications proven to be highly useful and often essential pieces of equipment for performing various necessary industrial and construction operations. However, in spite of the overall excellent safety record which hoists have earned and continue to justify, there is a possibility of inadvertent and unforeseeable failure inherent in any piece of equipment, no matter how well and carefully designed, constructed, maintained and operated. For example, there is a possibility of rope failure.

Since there are certain critical situations where failure of a hoist would be especially serious, the problem of potential failure, even though remote, has received prior consideraion and various solutions have been suggested. For example, U.S. Pat. No. 3,786,935 describes an overhead crane with a single failure-proof hoist that includes a crank hook suspended by a pair of ropefalls. A disadvantage with the device described in this patent is that failure of one of the ropefalls will result in swinging motion of the load since the two ropefalls used to support the load are wound upon opposite ends of the lifting drum.

U.S. Pat. No. 4,069,921 describes a single failure-proof hoist assembly that includes a rotatable drum, drive means for rotating the drum, an upper sheave block, and a lower sheave block supporting a hook assembly. A pair of wire ropes, each capable of fully supporting the load, are wound around the drum and reeved through the upper and lower sheave block and function to support the lower sheave block and the hook assembly in suspended relation. The hoist assembly also includes an equalizer assembly to compensate for variations in the lengths of the two ropes.

U.S. Pat. No. 4,073,476 describes an overhead crane with redundant safety features that includes two independently reeved hoisting systems. Each hoisting system engages one element of a dual element hook and each system is capable of supporting and lifting a first load on the hook. The hoisting systems are adapted to operate in unison to provide redundant safety features when supporting and lifting the first load and, additionally, to support and lift a second load which is greater than the first load. Each independent hoisting system is comprised of: an upper sheave assembly, which includes a plurality of sheaves, mounted on the frame of the crane; a block sheave assembly, which includes a plurality of sheaves, suspended from the frame; at least two ropes reeved on the sheaves of the upper sheave and block sheave assemblies; a take-up means for extending and retracting the ropes, with one of the ends of each rope attachd to the take-up means; and an equalizer bar.

U.S. Pat. No. 4,175,727 describes a hoist with a safety device for uncoupling the prime mover and the high speed, high-kinetic energy components of a drive train from the load following accidental stopping of the load by an external force. A torque-limiting device is provided in the high-speed end of the crane drive which transmits the required running-and static-torques in both directions, but limits the amount of torque which can be imposed on the system by the drive motor and dissipates the kinetic energy of the high-speed end of the drive train when the drive train becomes overloaded. The hoist described in this patent includes diverse-and dual-load paths for supporting critical loads following single failure of the drive train.

U.S. Pat. No. 4,177,973 describes a cable drum safety brake that includes a sensing mechanism which measures the revolutions of both the prime mover and the cable drum. The relationship between the rotation of the prime mover and the rotation of the cable drum corresponds to the speed reduction ratio of the drive train in normal operation. A detection circuit examines the rotation of the prime mover and cable drum for a deviation from this relationship and actuates a cable drum braking mechanism in response thereto to stop the rotation of the cable drum.

Federal regulations require, among other things, that the design of the rope reeving systems for overhead cranes for use in nuclear facilities be dual with each system providing separately the load balance on the head and load blocks through configuration of ropes and rope equalizers.

SUMMARY OF THE INVENTION

Hoists of the type illustrated in the drawings and hereinafter described are particularly suitable for hoisting critical loads in situations wherein in the event of failure of a load-supporting element, the hoist will still be able to support the load without objectionable impact loading being imparted to the supporting system and without excessive or objectionable swinging, twisting or other movement being imparted to the load. Broadly stated, the present invention contemplates the provision of a hoist with redundant safety features comprising: a hoist support frame; lifting drum means mounted on said hoist support frame; load block assembly means; equalizer assembly means being suspended by a first set of ropefalls and a second set of ropefalls, each of said ropefalls having one end secured to said lifting drum means and the other end secured to said equalizer assembly means, each of said sets of ropefalls having sufficient load bearing capacity to carry the load carried by the other set of ropefalls in addition to its own load; each of said ropefalls having first sections extending from said lifting drum means to said load block assembly means and second sections extending from said load block assembly means to said equalizer assembly means, each of said first sections being positioned in a substantially common plane with each other, and each of said second sections being positioned in another substantially common plane with each other; said equalizer assembly means including first load balancing means for balancing the load carried by said first set of ropefalls, second load balancing means for balancing the load carried by said second set of ropefalls, and load sensor means for generating an electrical signal in response to variations in the load carried by said first or said second set of ropefalls.

In a preferred embodiment, the foregoing hoist includes upper sheave means mounted on said hoist support frame, said first and said second sets of ropefalls being reeved through said upper sheave means. Advantageously, the foregoing hoist also includes brake means mounted on said hoist support frame for stopping the rotation of said lifting drum means, and speed sensor means for generating an electrical signal in response to the rotational rate of said lifting drum means exceeding a predetermined level, said brake means being activatable by said electrical signal from said speed sensor means and/or said load sensor means. In a particularly advantageous embodiment said lifting drum means comprises a single lifting drum with two sets of grooves on one side of its midpoint and two sets of grooves on the other side of its midpoint.

Advantageously, said equalizer assembly means comprises: equalizer support means mounted on the foregoing hoist support frame, said first load balancing means comprising a first ropefall support member pivotally mounted on said equalizer support means, said first ropefall support member having arms extending outwardly from its midpoint, the other ends of the ropefalls of said first set of ropefalls being secured to the arms of said first ropefall support member; said second load balancing means comprising a second ropefall support member pivotally mounted on said equalizer support means, said second ropefall support member having arms extending outwardly from its midpoint, the other ends of the ropefalls of said second set of ropefalls being secured to the arms of said second ropefall support member; and load sensor means comprising a first load sensor mounted on said equalizer support means adapted to sense the load carried by said first ropefall support member and to generate an electrical signal when said load carried by said first ropefall support member is varied, and a second load sensor mounted on said equalizer support means adapted to sense the load carried by said second ropefall support member and to generate an electrical signal when said load carried by said second ropefall support member is varied. The brake means employed with the foregoing hoist assembly preferably comprises a pair of brake shoes mounted on the hoist support frame and engageable with said lifting drum means, toggle arm means for moving said brake shoes into and out of contacting engagement with said lifting barrel, spring means for activating said toggle arm means to move said brake shoes into contacting engagement with said lifting drum means, and hydraulic means for restraining said spring means from moving said brake shoes into contacting engagement with said lifting drum means and for activating said toggle arm means to move said brake shoes out of contacting engagement with said lifting drum means.

The present invention also contemplates the provision of an equalizer assembly comprising trunnion means, an inner support member mounted on said trunnion means and extending downwardly from said trunnion means, a second support beam pivotally depending from said inner support member, an outer support member mounted on said trunnion means and extending coaxially with said inner support member downwardly from said trunnion means, a first upper support beam pivotally depending from said outer support member, a second load sensor mounted on said inner support member adapted to sense the load carried by said second support beam and to generata an electrical signal when said load carried by said second support beam is varied beyond a predetermined amount, and a first load sensor mounted on said outer support member adapted to sense the load carried by said first support beam and to generate an electrical signal when said load carried by said first support beam is varied beyond a predetermined amount. Preferably, the foregoing equalizer assembly includes antitwist means depending from said trunnion means.

The foregoing hoist can be adapted for use with any suitable hoisting mechanism or crane, but is particularly suitable for use with polar cranes. The hoists of the present invention can be mounted, for example, directly on such cranes or mounted on crane trolleys which are adapted for travel along the bridges of such cranes.

BRIEF DESCRIPTION OF THE DRAWINGS

In the annexed drawings, like figures identify like parts or features.

DETAILED DESCRIPTION OF THE PREFERRED EMBODIMENT

Figure 1:
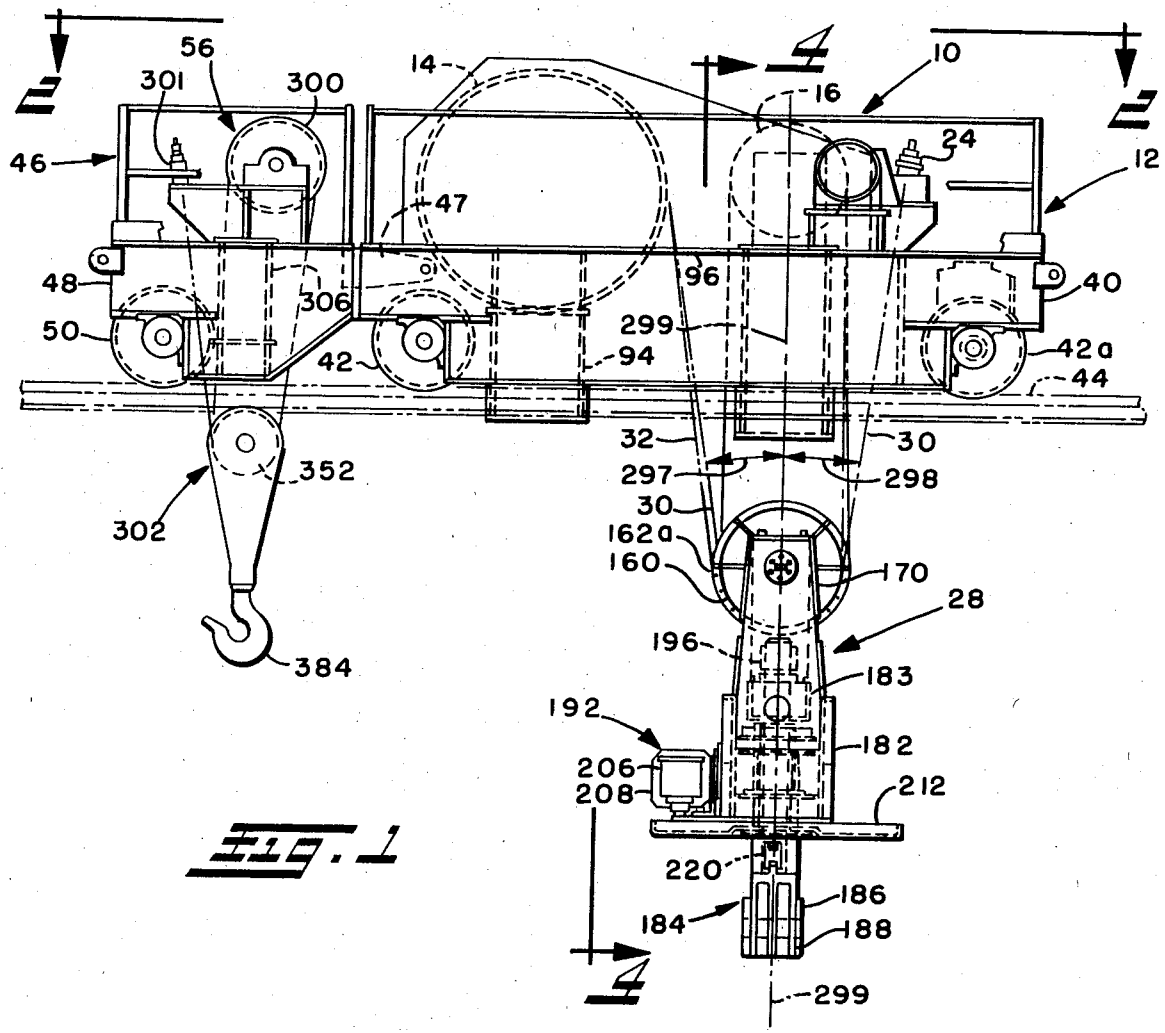
FIG. 1 is a side elevational view of a crane trolley embodying the present invention in a particular form.

The hoist of the present invention, which in its illustrated embodiment is indicated generally by the reference numeral 10, is mounted on a crane trolley, which is indicated generally by the reference numeral 12. Hoist 10 comprises lifting drum 14, upper sheaves 16, 18, 20 and 22, and equalizer assembly 24, all of which are mounted on frame 40 of trolley 12, and load block assembly 28 which is suspended from lifting drum 14, sheaves 16, 18, 20 and 22, and equalizer assembly 24 by ropefalls 30, 32, 34 and 36, all as hereinafter further explained.

It will be understood by those skilled in the art that the hoist of the present invention can be employed with any hoisting mechanism or crane, but is particularly suitable for use with cranes wherein redundant safety measures are preferred or required. The cranes which can be employed in accordance with the present invention include, for example, polar cranes which are adapted for movement about a circular track and are particularly adaptable for use in nuclear powered electric generating plants. Polar cranes are well known to those skilled in the art and are described, for example, in Canadian Pat. Nos. 849,351 and 1,102,285, which are incorporated herein by reference. Rotating bridge cranes, which are pinned at one end of a vertical axis with the other end mounted for rotational movement on circular or arcuate track, are readily adaptable for use with the hoists of the present invention. Overhead traveling cranes which move transversely along horizontally elongated overhead parallel tracks that are mounted, for example, on a building structure, and gantry cranes, which are similar in construction and design to overhead traveling cranes except that the overhead bridge is carried at each end by vertically elongated tressels which travel along tracks mounted on the ground, can also be used in accordance with the present invention. In some instances, an overhead crane supported at one end by an overhead track mounted, for example, on the side of the building structure and supported at the other end by a vertically elongated tressel traveling on tracks mounted on the ground can also be used in accordance with the present invention. The hoist of the present invention can be mounted either on the bridge of a crane, or on a crane trolley adapted for travel along the bridge of such crane. In the illustrated embodiment, the hoist 10 is described as being mounted on trolley 12 which is adapted for travel along the bridge of a crane.

Trolley 12 has a substantially rectangular trolley frame 40 which is mounted on wheels 42 and 42*a* and is adapted for horizontal travel along horizontally elongated parallel spaced tracks 44. In the illustrated embodiment, an auxiliary trolley, which is indicated generally by the reference numeral 46, is attached to trolley 12 by brackets 47. Auxiliary trolley 46 has an auxiliary trolley frame 48 which is mounted on auxiliary wheels 50 and is adapted for travel along tracks 44. Tracks 44 are mounted on horizontally elongated parallel spaced girders 52 which form part of the bridge of the crane for which hoist 10 is to be employed; such crane being any of the above mentioned cranes, preferably a polar crane. Trolley frame 40 and auxiliary trolley frame 48 are sufficiently transversely elongated to span the opening between girders 52. Trolley frame 40 is sufficiently longitudinally elongated to support hoist 10 and the drive assembly, indicated generally by the reference numeral 54, for driving trolley 12 and auxiliary trolley 46 along tracks 44. Auxiliary trolley 46 is sufficiently longitudinally elongated to support an auxiliary hoist assembly which is indicated generally by the reference numeral 56.

As indicated, trolley 12 is driven along tracks 44 by drive assembly 54. Auxiliary trolley 46 has no drive assembly of its own, it is also driven by drive assembly 54. Drive assembly 54 (FIG. 2) is powered by electric motor 60 which is mounted on mounting bracket 62 which in turn is mounted on floor section 63 of trolley frame 40. Motor 60 is rotatably connected to gear reducer 64 by coupling 66. Gear reducer 64 is mounted on floor section 63. Electrically operated brake 68 is mounted on motor 60 and is adapted for engaging and stopping the rotation of the drive shaft of motor 60. Electrically operated brake 70 is mounted on gear reducer 64 and is adapted for engaging and stopping the rotation of gear reducer 64. Motor 60, coupling 66, brakes 68 and 70, and the upper portion of gear reducer 64 are aligned with one another and positioned in a vertical plane above drive shaft 72. Gear reducer 64 projects vertically downwardly. Drive shaft 72 is positioned vertically below motor 60, coupling 66 and brakes 68 and 70, and is rotatably attached to the lower portion of gear reducer 64. Mounted on the ends of drive shaft 72 are wheels 42*a*. Drive shaft 72 is attached to gear reducer 64 by couplings 74 and 76 (coupling 76 not being shown in the drawings) and to wheels 42*a* by couplings 78 and 80. Wheels 42*a* are rotatably mounted on wheel mounting brackets 82 which are mounted on trolley frame 40. Motor 60 and brakes 68 and 70 are activated and controlled from a centrally located operator station. The rotation of the drive shaft of motor 60 transmits rotational motion to gear reducer 64 which in turn causes drive shaft 72 to rotate and drive wheels 42*a*. The rotation of the drive shaft of motor 60 in one direction drives trolley 12 and auxiliary trolley 46 in one direction along tracks 44, while the rotation of the drive shaft of motor 60 in the opposite direction drives trolley 12 and auxiliary trolley 46 in the opposite direction along tracks 44. The movement of trolley 12 and auxiliary trolley 46 is slowed or stopped by the activation of brakes 68 and 70. It is to be understood that only one of the brakes 68 or 70 is needed to slow or stop trolley 12 and auxiliary trolley 46, but both brakes 68 and 70 are provided for the purposes of providing redundant safety measures. Thus, while one of the brakes 68 or 70 is adequate under various conditions, both are preferred.

Lifting drum 14 is supported at one end by gear reducer 90 and at the other end by bearing assembly 92. Lifting drum 14 is rotatably attached to gear reducer 90 and bearing 92. Gear reducer 90 is mounted on cross beams 94 and 96 which form part of trolley frame 40. Bearing assembly 92 is mounted on a pedestal (not shown in the drawings) which in turn is mounted on cross beam 94. The rotation of lifting drum 14 is powered by electric motor 98 which is mounted on mounting bracket 100 which in turn is mounted on trolley frame 40. Electrically operatd brake 102 is mounted on motor 98 and is adapted for engaging the drive shaft of motor 98. Brake 102 is adapted to reduce or stop the rotation of lifting drum 14 and, optionally lock lifting drum 14 in place during the transport of crane loads. Motor 98 is rotatably attached to gear reducer 90 by coupling 104. The rotation of the drive shaft of motor 98 transmits rotational motion to gear reducer 90 which in turn causes lifting drum 14 to rotate. The rotation of the drive shaft of motor 98 in one direction rotates lifting drum 14 in one direction, while the rotation of the drive shaft of motor 98 in the opposite direction rotates lifting drum 14 in the opposite direction.

Figure 3:
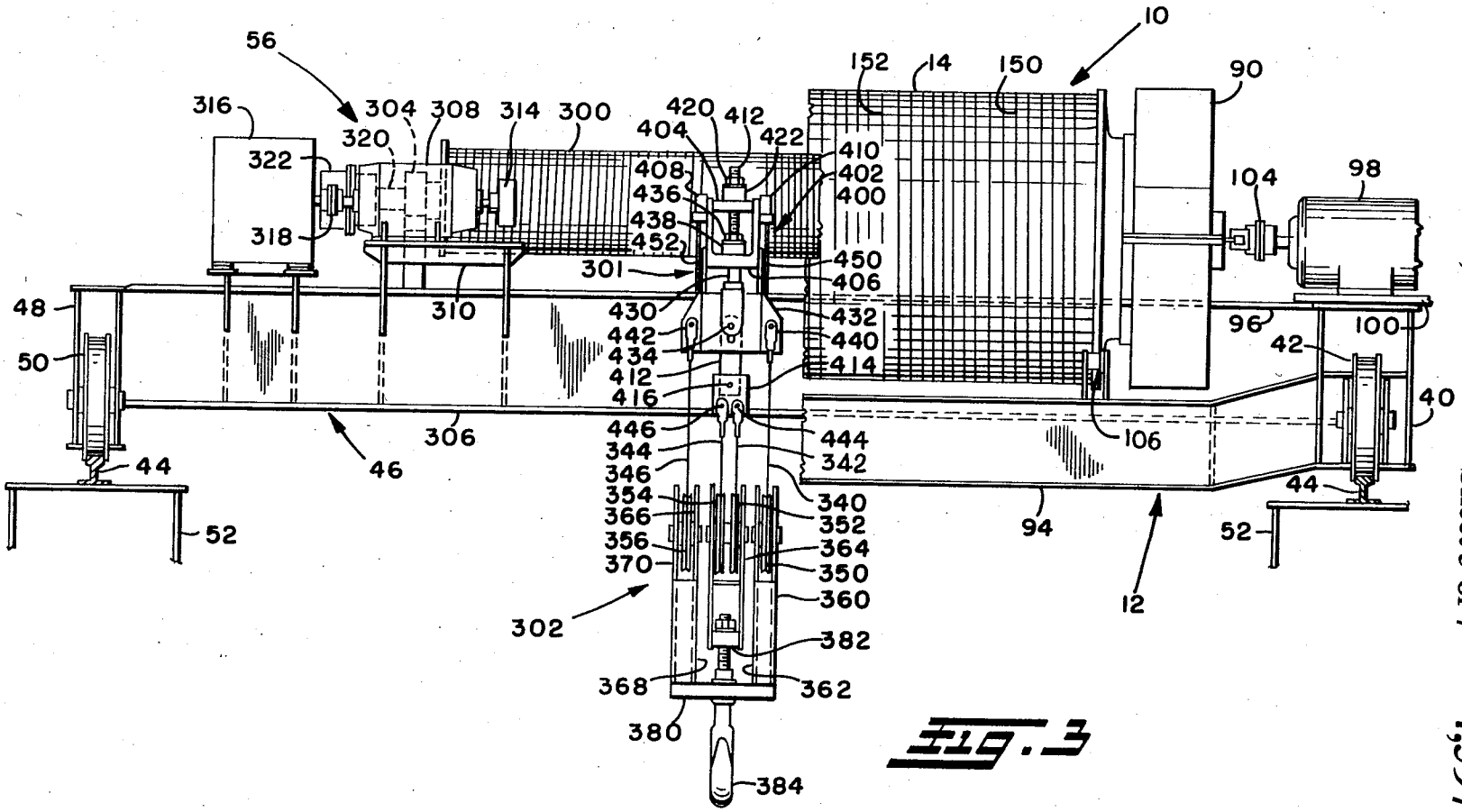
FIG. 3 is an enlarged elevational view of the trolley of FIG. 1 taken along line 3—3 of FIG. 2.

A pair of rollers 106 (FIG. 3) is mounted on cross beam 94 and positioned below each of the ends of lifting drum 14. In all, four rollers 106 are employed, two of such rollers on the right side of lifting drum 14, as illustrated in FIG. 3, and two of such rollers on the left side. Only one of such rollers is actually illustrated in the drawings. Rollers 106 are provided to support lifting drum 14 in the event of failure of the main shaft of lifting drum 14 or gear reducer 90 or bearing 92. It is to be understood that other secondary support features could be employed in place of rollers 106. However, the use of rollers 106 is preferred so that in the event of failure of one of the support elements of lifting drum 14, such lifting drum could be sufficiently rotated to permit lowering of the crane load.

Figure 2:
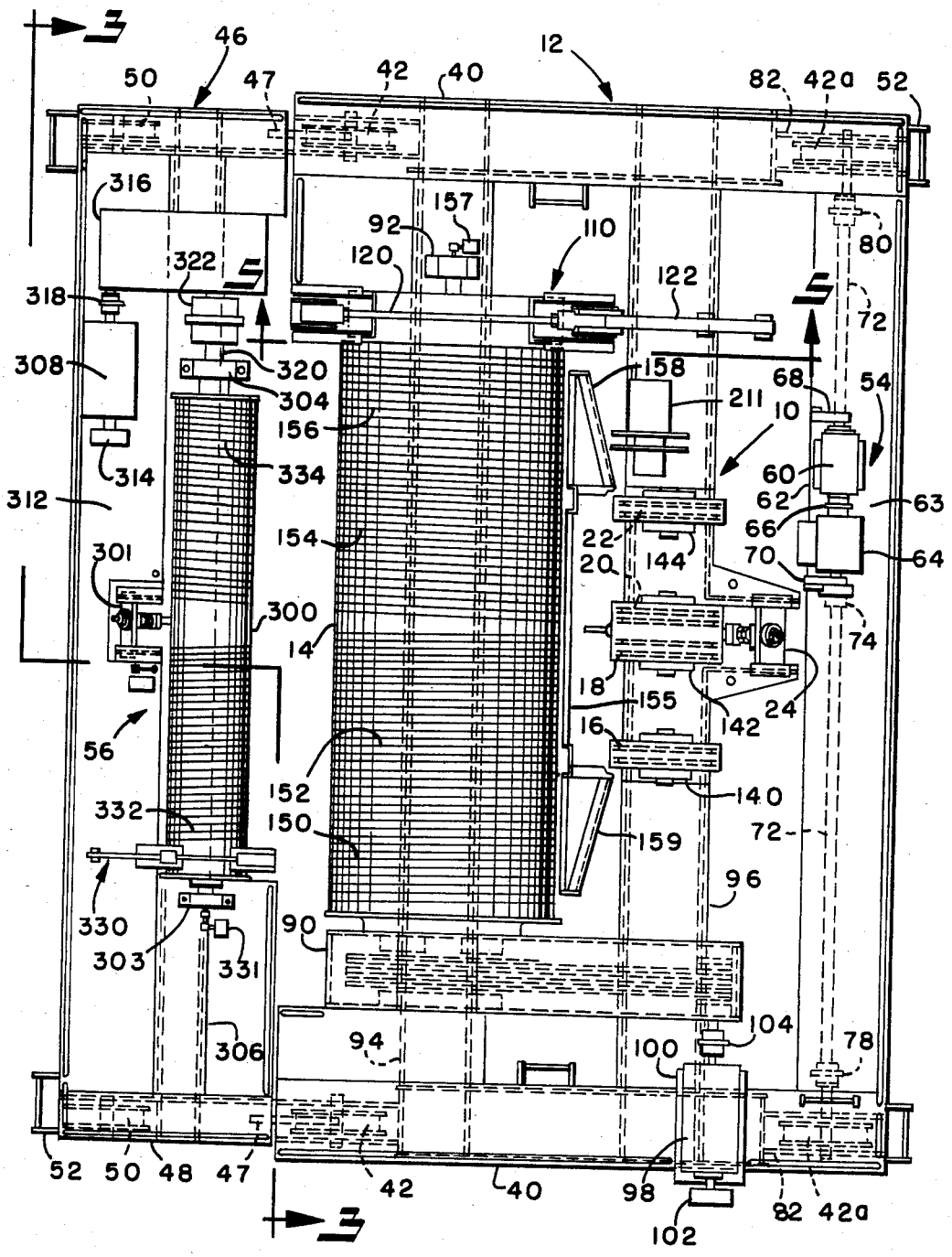
FIG. 2 is a top plan view of the trolley of FIG. 1 taken along line 2—2 of FIG. 1.
Figure 5:
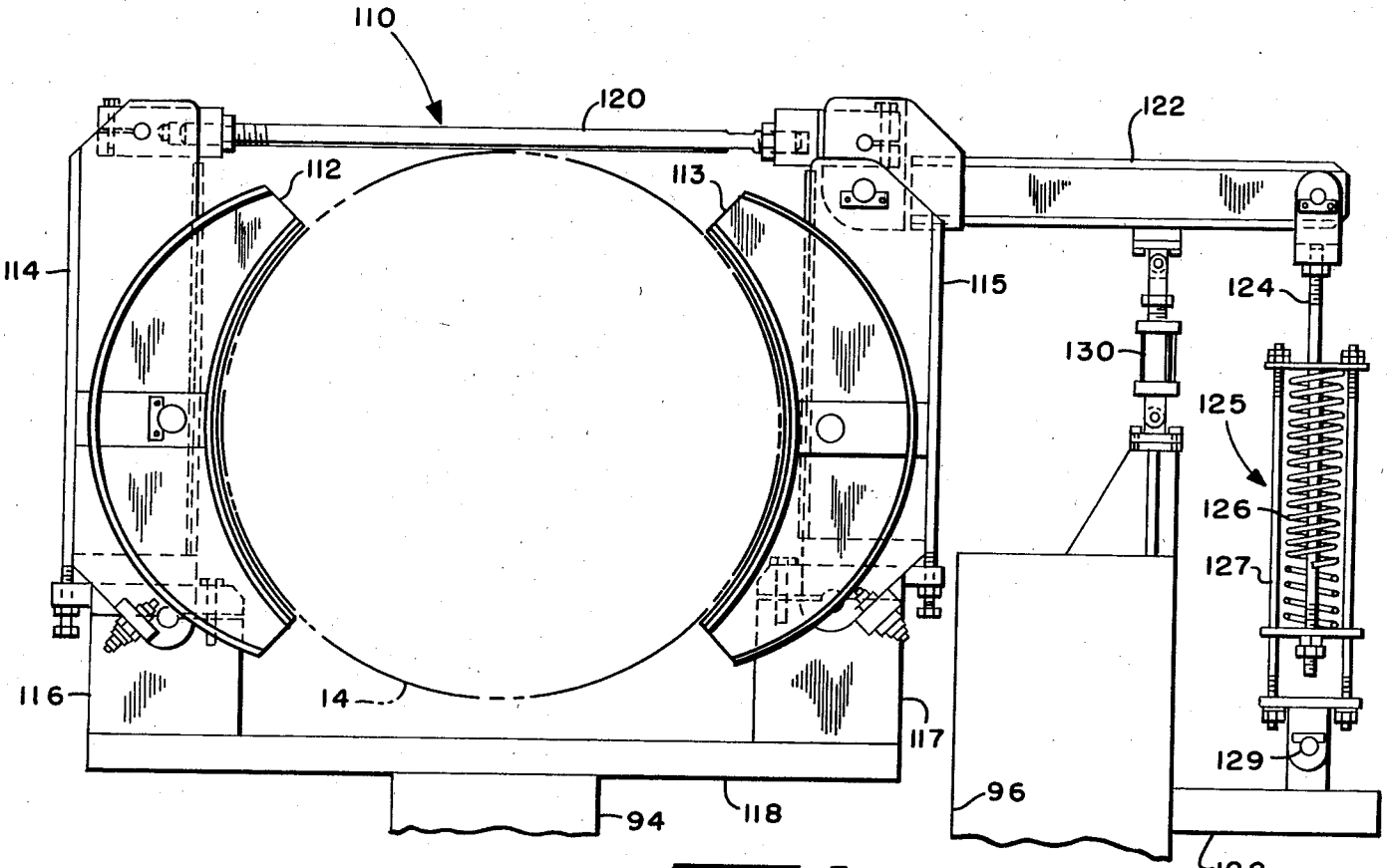
FIG. 5 is an enlarged elevational view of the trolley of FIG. 1 taken along line 5—5 of FIG. 2, illustrating a brake assembly used in accordance with the present invention.

A brake assembly, which is best illustrated in FIGS. 2 and 5 and is generally indicated by the reference numeral 110, is mounted on cross beams 94 and 96 of trolley frame 40 and is adapted for stopping the rotation of lifting drum 14 in response to electrical signals from either a high speed sensor (described hereinafter) attached to lifting drum 14, or a load sensor (described hereinafter) attached to equalizer assembly 24. Brake mechanism 110 has a pair of brake shoes 112 and 113 which are adapted for engaging the end of lifting drum 14 adjacent bearing assembly 92. Brake shoes 112 and 113 are pivotally attached to brake arm weldments 114 and 115, respectively, which in turn are pivotally mounted on brake arm support elements 116 and 117, respectively. Support elements 116 and 117 are mounted on cross plate 118 which is mounted on cross beam 94. Brake arm weldments 114 and 115 are connected to each other by horizontal tie rod 120. Tie rod 120 is pivotally attached to brake arm weldments 114 and 115. Toggle arm 122 is pivotally attached at one end to brake arm weldment 115 and pivotally attached at the other end to plunger 124. Plunger 124 is attached to spring assembly 125 which in turn is pivotally attached to support bracket 128 by pin 129. Bracket 128 projects horizontally from and is fixedly attached to cross beam 96. Spring assembly 125 includes helical spring 126 which is contained within spring housing 127. Spring 126 is resiliently biased so as to tend to pivot toggle arm 122 about brake arm 115 in clockwise direction, as illustrated in FIG. 5, to engage brake shoes 112 and 113 against lifting drum 14. Hydraulic cylinder assembly 130 is mounted on cross beam 96 and is pivotally attached to toggle arm 122. Hydraulic cylinder assembly 130 is deactivated by electrical signals from the speed sensor (described hereinafter) attached to equalizer assembly 24. Hydraulic assembly 130 restrains clockwise movement of toggle arm 122 by applying an upward force on toggle arm 122 sufficient to overcome the downward force applied by spring 126. When hydraulic assembly 130 is deactivated the upward force maintained by hydraulic assembly 130 on toggle arm 122 is released which permits spring 126 to pivot toggle arm 122 clockwise about brake arm 115 causing brake shoes 112 and 113 to close and engage lifting drum 14. Brake shoes 112 and 113 are disengaged from lifting drum 14 by activating hydraulic assembly 130. The activation of hydraulic cylinder 130 results in an upward force applied to toggle arm 122 sufficient to overcome the bias in spring 126 to return toggle arm 122 to the position illustrated in FIG. 5 and disengage brake shoes 112 and 113 from lifting drum 14. It will be understood by those skilled in the art that although it has been indicated the hydraulic cylinder 130 is deactivated by electrical signals from the hereinafter-described speed sensor or load sensor, such hydraulic cylinder 130 can also be deactivated by any other suitable means. Hydraulic cylinder assembly 130 can also be activated by any suitable means. for example, hydraulic cylinder 130 can be activated and deactivated from a centrally located operator station by the operator of hoist 10.

High speed sensor 157 is mounted on bearing assembly 92 and is adapted for sensing the rate of rotation of lifting drum 14. In the event the rotational rate of lifting drum 14 exceeds a predetermined rate, sensor 157 generates an electrical signal which activates brake mechanism 110 to stop the rotation of lifting drum 14 and/or activates an alarm. In actuality, the electrical signal deactivates hydraulic assembly 130 which permits spring 126 to pivot toggle arm 122 to close brake shoes 112 and 113 to engage lifting drum 14, i.e., the electrical signal activates brake mechanism 110. Preferably, sensor 157 is set so as to generate such electrical signal in the event the rotational rate of lifting drum 14 exceeds by about 10% the maximum rotational rate intended for it.

Upper sheaves 16, 18, 20 and 22 are coaxially aligned with each other. The center axes of sheaves 16, 18, 20 and 22 are positioned in parallel spaced relationship with the center axis of lifting drum 14. Sheave 16 is rotatably mounted on bearing block 140 which in turn is mounted on cross beam 96. Sheaves 18 and 20 are rotatably mounted on bearing block 142 which in turn is mounted on cross beam 96. Sheave 22 is rotatably mounted on bearing block 144 which in turn is mounted on cross beam 96. Each of the sheaves 16, 18, 20 and 22 has two sheave wheels. It will be understood by those skilled in the art that upper sheaves 16, 18, 20 and 22 do not have to be positioned on a common axis. It is preferable, however, that outboard sheaves 16 and 22 be mounted coaxial to each other and positioned in a common horizontal plane. Similarly, it is preferable that inboard sheaves 18 and 20 be mounted coaxial to each other and positioned in a common horizontal plane. It will also be understood by those skilled in the art that the number and use of upper sheaves is optional.

Lifting drum 14 has two sets of right-handed grooves, indicated generally by the reference numerals 150 and 152, formed on its surface between the midportion of lifting drum 14 and the end of lifting drum 14 adjacent to gear reducer 90. Lifting drum 14 also has two sets of left-handed grooves, indicated generally by the reference numerals 154 and 156, formed on its surface between the midportion of lifting drum 14 and the end of lifting drum 14 adjacent to brake assembly 110. Right-handed grooves 150 and 152 are adapted for coiling and uncoiling ropefalls 30 and 32, respectively. Left-handed grooves 154 and 156 are adapted for coiling and uncoiling ropefalls 34 and 36, respectively. One end of each of the ropefalls 30, 32, 34 and 36 is secured to lifting drum 14, while the other end of each of said ropefalls is secured to equalizer assembly 24, as hereinafter described. Guard 155, which is attached to mounting brackets 158 and 159 which in turn are mounted on cross beam 96, is positioned adjacent to lifting drum 14 to maintain ropefalls 30, 32, 34 and 36 in their respective grooves.

Figure 4:
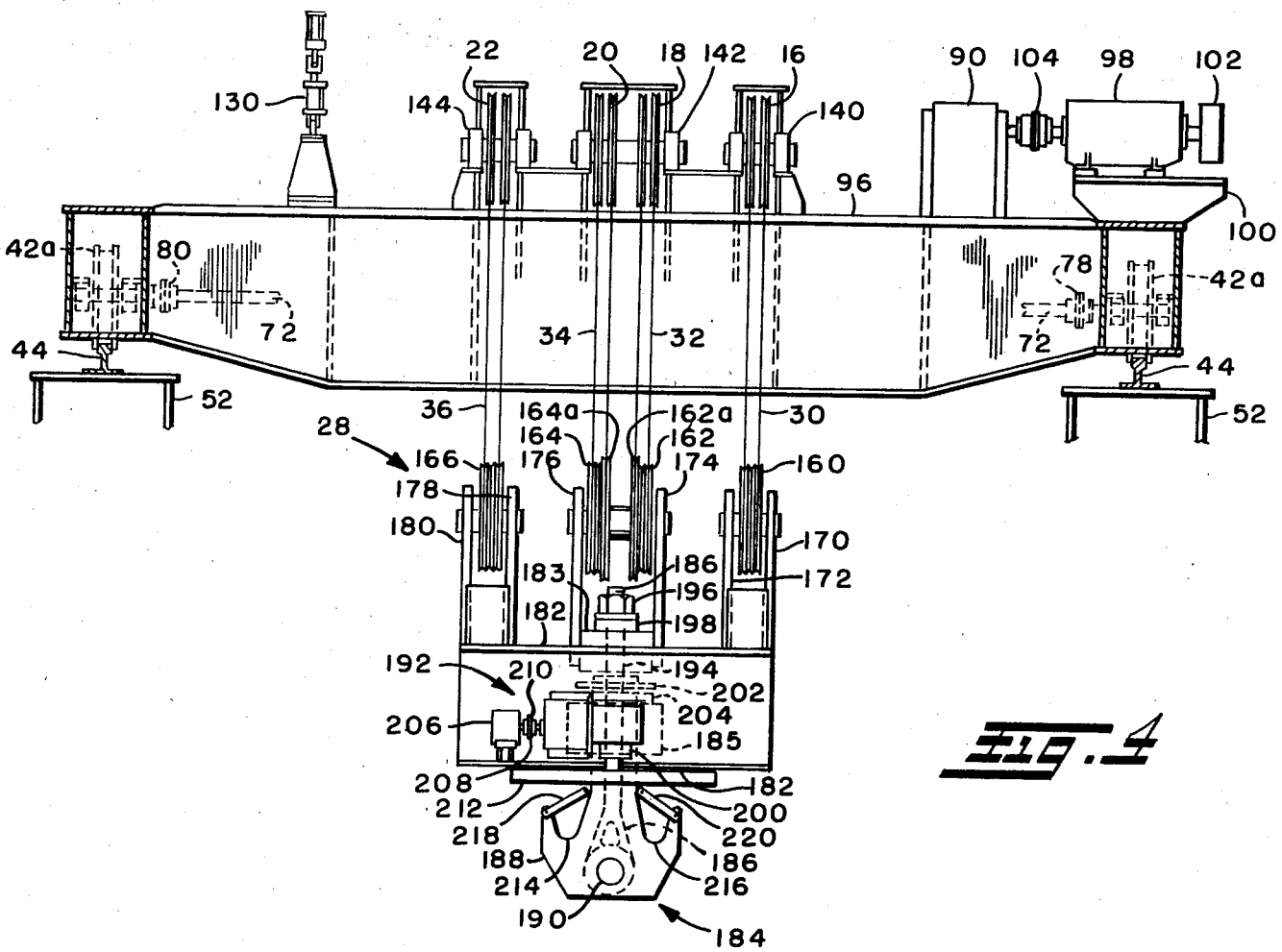
FIG. 4 is an elevational view of the trolley of FIG. 1 taken along line 4—4 of FIG. 1.

Lower sheaves 160, 162, 164 and 166 are rotatably mounted on load block assembly 28. Sheaves 160, 162, 164 and 166 are positioned coaxial to each other in a common horizontal plane. Each of the lower sheaves 160, 162, 164 and 166 have three sheave wheels. The lead sheave wheels **162*a* and 164*a* of sheaves 162 and 164 are the same size and slightly larger than the other ten sheave wheels of sheaves 160, 162, 164 and 166, which are all the same size. The larger sheave wheels 162*a* and 164*a* are provided to reduce or eliminate abrasion between ropefalls by slightly displacing part of the ropefalls 32 and 34 reeved through sheave wheels 162*a* and 164*a* from the common plane of the corresponding parts of ropefalls 30 and 36. Such parts of ropefalls 32 and 34 are, however, substantially in the same plane as the corresponding parts of ropefalls 30 and 36 as discussed in greater detail below. For a 250 ton hoist, for example, sheave wheels 162*a* and 164*a* can have a diameter of about thirtynine inches and the other ten sheave wheels of sheaves 160, 162, 164 and 166 can have a diameter of about thirty-six inches. Referring to FIG. 4, the three sheave wheels of lower sheave 160 are rotatably mounted on and positioned between vertically extending parallel spaced plates 170 and 172. The three sheave wheels of lower sheave 162 and the three sheave wheels of lower sheave 164 are rotatably mounted on and positioned between vertically extending parallel spaced plates 174 and 176. The three sheave wheels of lower sheave 166 are rotatably mounted on and positioned between vertically extending parallel spaced plates 178 and 180. Plates 170, 172, 174, 176, 178 and 180 are welded to main weldment 182 of load block assembly 28. A hook assembly, which is indicated generally by the reference numeral 184, is mounted on main weldment 182**.

Hook assembly 184 has an inner hook assembly 186 and an outer hook assembly 188. Hook assemblies 186 and 188 have a common eye portion 190 for attaching loads. Hook assembly 188 also has hook portions 214 and 216 for attaching loads. Hook portions 214 and 216 have safety latches 218 and 220, respectively. A drive assembly, which is indicated generally by the reference numeral 192, is mounted on main weldment 182 and is adapted for rotating hook assemblies 186 and 188. Hook assembly 186 has a vertical rod portion 194 which is secured to inner hook block 183 by nut 196. Thrust bearing 198 is positioned between hook block 183 and nut 196. Hook assembly 188 depends from support member 200 which in turn is secured to outer hook block portion 185 by nut 202. Hook block portion 185 is welded to main weldment 182. Thrust bearing 204 is positioned between nut 202 and block portion 185. Rod portion 194 and support member 200 are coaxially alignd with each other. Drive assembly 192 is powered to electric motor 206 which is mounted on main weldment 182 and is rotatably connected to gear reducer 208 by coupling 210. Gear reducer 208 is mounted on main weldment 182. Spring loaded cable reel 211 (FIG. 2), which is mounted on cross beam 96, provides electric motor 206 with its power line. Gear reducer 208 (FIG. 4) has a driven shaft projecting vertically downwardly into chain drive assembly 212. Hook assembly 188 has a sprocket wheel projecting from it and positioned within chain drive assembly 212. A chain drive connects the driven shaft of gear reducer 208 and the sprocket wheel of hook assembly 188. The rotation of the drive shaft of motor 206 transmits rotational motion to gear reducer 208 which in turn drives chain drive assembly 212 causing hook assembly 188 to rotate relative to main weldment 182 and sheaves 160, 162, 164 and 166. The rotation of the drive shaft of motor 206 in one direction causes hook assembly 188 to rotate in a clockwise direction, while the rotation of the drive shaft of motor 206 in the opposite direction causes hook assembly 188 to rotate in a counterclockwise direction. Since hook assemblies 186 and 188 have a common eye 190, the rotation of hook assembly 188 causes the rotation of hook assembly 186.

Figure 6:
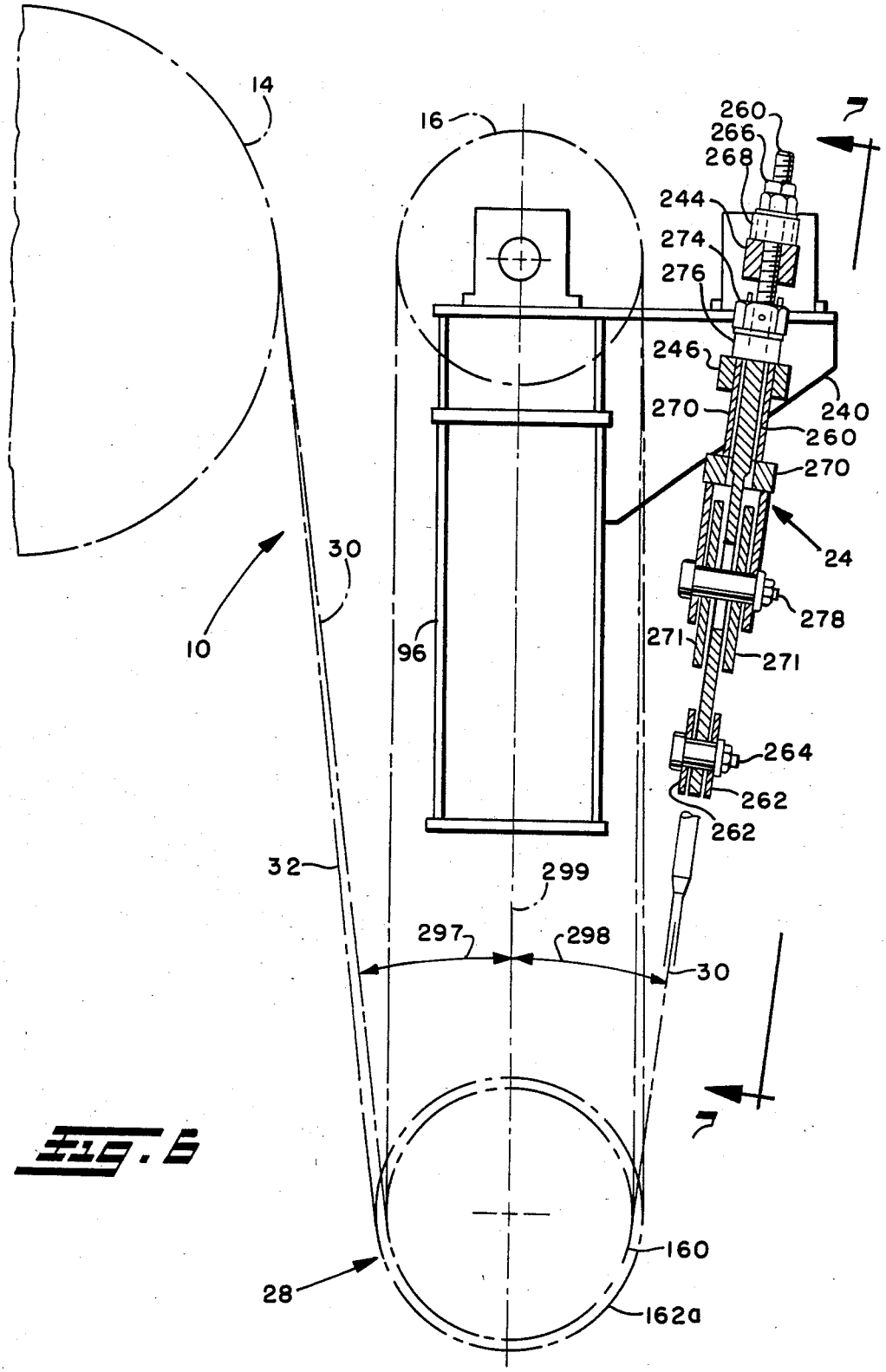
FIG. 6 is an enlarged, partially cross-sectioned, partially perspective, side elevational view of an equalizer assembly employed in the trolley of FIG. 1.
Figure 7:
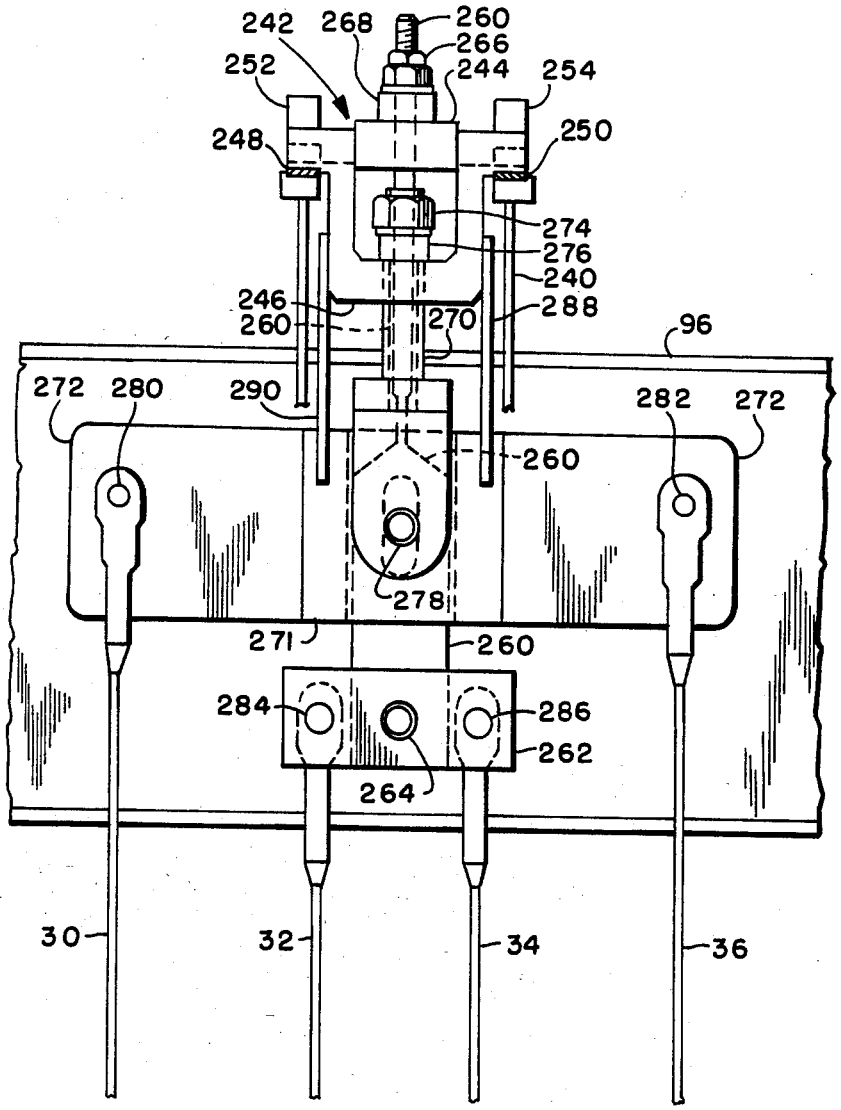
FIG. 7 is an elevational view of the equalizer assembly illustrated in FIG. 6 taken along line 7—7 of FIG. 6.

Equalizer assembly 24, which is best illustrated in FIGS. 6 and 7, is pivotally mounted on mounting bracket 240 which in turn is welded to cross beam 96. Equalizer assembly 24 has a trunnion which is indicated generally by the reference numeral 242. Trunnion 242 has an upper straight trunnion section 244 and a lower U-shaped trunnion section 246. Trunnion 242 is seated on bushings 248 and 250 and is secured to bracket 240 by bearing assemblies 252 and 254. Inner support member 260 is mounted on straight trunnion section 244 and extends downwardly to lower support beam 262. Lower support beam 262 is pivotally attached to support member 260 by pin 264. Support member 260 is secured to trunnion section 244 by nut 266. Donut-shaped load cell 268 is positioned between nut 266 and trunnion section 244. Outer support member 270 is mounted on trunnion section 246 and extends downwardly to support beam 271. Support beam 271 is pivotally attached to support member 270 by pin 278. Support beam 271 has horizontally projecting arms 272. Support member 270 is secured to trunnion section 246 by nut 274. Donut-shaped load cell 276 is positioned between nut 274 and trunnion section 246. Support members 260 and 270 are coaxially aligned with each other. Ropefalls 30 and 36 are pivotally attached to arms 272 by pins 280 and 282, respectively. Ropefalls 32 and 34 are pivotally attached to lower support beam 262 by pins 284 and 286, respectively. Antitwist plates 288 and 290 are welded to and depend from trunnion section 246 and are provided to prevent support beam 271 from twisting. Donut-shaped load cells 268 and 276 are prestressed in such a manner so that the resistance within such load cells is changed sufficiently to generate an electrical signal when the loads supported by support beam 262 and support beam 271, respectively, are varied upwardly or downwardly beyond a predetermined level.

Ropefalls 30, 32, 34 and 36 are reeved as follows. Ropefall 30, which is coiled and uncoiled in grooves 150 of lifting drum 14, drops to sheave 160, wraps around one of the wheels of sheave 160, extends upwardly to sheave 16, wraps around one of the wheels of sheave 16, drops to sheave 160, wraps around another wheel of sheave 160, extends upwardly to sheave 16, wraps around the other wheel of sheave 16, drops to sheave 160, wraps around the third wheel of sheave 160, and then extends upwardly to equalizer assembly 24 and is attached to support arm 272 by pin 280. Ropefall 32, which is coiled and uncoiled in grooves 152, drops to sheave 162, wraps around sheave wheel **162*a*, extends upwardly to sheave 18, wraps around one of the wheels of sheave 18, drops to sheave 162, wraps around the middle wheel of sheave 162, extends upwardly to sheave 18, wraps around the other wheel of sheave 18, drops to sheave 162, wraps around the third wheel of sheave 162 and then extends upwardly to equalizer assembly 24 and is attached to support beam 262 by pin 284. Ropefall 34, which is coiled and uncoiled in grooves 154, drops to sheave 164, wraps around sheave wheel 164*a*, extends upwardly to sheave 20, wraps around one of the wheels of sheave 20, drops to sheave 164, wraps around the middle wheel of sheave 164, extends upwardly to sheave 20, wraps around the other wheel of sheave 20, drops to sheave 164, wraps around the third wheel of sheave 164, and then extends upwardly to equalizer assembly 24 and is attached to support beam 262 by pin 286. Ropefall 36, which is coiled and uncoiled in grooves 156, drops to sheave 166, wraps around one of the wheels of sheave 166, extends upwardly to sheave 22, wraps around one of the wheels of sheave 22, drops to sheave 166, wraps around another wheel of sheave 166, extends upwardly to sheave 22, wraps around the other wheel of sheave 22, drops to sheave 166, wraps around the third wheel of sheave 166, and then extends upwardly to equalizer assembly 24 and is attached to support arm 272 by pin 282. The rotation of lifting drum 14 in one direction coils ropefalls 30, 32, 34 and 36 resulting in a consequent shortening of such ropefalls and lifting of load block assembly 28. The rotation of lifting drum 14 in the opposite direction uncoils ropefalls 30, 32, 34 and 36 resulting in a consequent lengthening of such ropefalls and the lowering of load block assembly 28**.

Each of the sections of ropefalls 30, 32, 34 and 36 extending between lifting drum 14 and load block assembly 28 are positioned in a substantially common plane with each other and form an angle 297 (FIGS. 1 and 6) with the vertical center line 299 of load block assembly 28. Similarly, each of the sections of ropefalls 30, 32, 34 and 36 extending between load block assembly 28 and equalizer assembly 24 are positioned in a substantially common plane with each other and form an angle 298 with the vertical centerline 299 of load block assembly 28. The vertical center line 299 of load block assembly 28 is also preferably the vertical centerline of upper sheaves 16, 18, 20 and 22. The angles 297 for ropefalls 30 and 36 are equal, within normally acceptable design tolerances, to each other and equal to the angles 298 for ropefalls 30, 32, 34 and 36. The angles 298 for ropefalls 30, 32, 34 and 36 are equal to each other. The angles 297 for ropefalls 32 and 34 are equal to each other and substantially equal to the angles 297 for ropefalls 30 and 36 and the angles 298 for ropefalls 30, 32, 34 and 36. In reference to ropefalls 32 and 34 the term "substantially equal" is used due to the fact that the angles 297 and 298 are slightly different due to the fact that lead sheave wheels **162*a* and 164*a* of sheaves 162 and 164, respectively, are slightly larger than the other sheave wheels of sheaves 160, 162, 164 and 166. The angles 297 and 298 for each ropefall 30, 32, 34 and 36 will vary depending upon the length of such ropefalls and, accordingly, the extent of descent or ascent of load block assembly 28. The term "substantially common plane" is used herein and in the appended claims due to the fact that the sections of ropefalls 32 and 34 extending between lifting drum 14 and load block assembly 28 are slightly displaced from the common plane in which the corresponding sections of ropefalls 30 and 36 are positioned. This displacement is due to the fact that ropefalls 32 and 34 are reeved through the slightly larger sheave wheels 162*a* and 164*a*. The term "substantially common plane" is also used because one or more of the ropefalls sections (extending between lifting drum 14 and load block assembly 28, or between load block assembly 28 and equalizer assembly 24) may not be exactly in the same plane as the others due to normally acceptable design tolerances. The foregoing equalities or substantial equalities of the angles 297 and 298 and the positioning of respective ropefall sections in substantially common planes are provided to reduce or eliminate swinging, twisting or other undesirable movement by load block assembly 28 in the event of failure of either one or both of ropefalls 30 and 36, or one or both of ropefalls 32 and 34, or a load supporting element of hoist 10**.

In the event ropefall 30 or 36 breaks, the pivotal action of beam 271 causes sufficient slackening of the other of such ropefalls to eliminate the load supported by beam 271. Under such circumstances, the load supported by beam 271 is transferred to support beam 262 and ropefalls 32 and 34. A loss of the load supported by beam 271 can also occur if there is a failure of a load supporting element of one or both of upper sheaves 16 or 22, one or both of lower sheaves 160 or 166, or hook assembly 188; in the event of any such failure the load supported by beam 271 is transferred to beam 262, ropefalls 32 and 34 and the reeving system associated with such ropefalls. The loss of the load supported by beam 271 results in a change in the resistance within load cell 276 and a consequent generation of an electrical signal. The electrical signal generated by load cell 276 activates brake mechanism 110 and thereby stops the rotation of lifting drum 14 and locks such lifting drum in place. Alternatively, the electrical signal generated by load cell 276 can be used to activate an alarm system in place of or in addition to activating brake mechanism 110.

In the event ropefall 32 or 34 breaks, the pivotal action of beam 262 causes sufficient slackening of the other of such ropefalls to eliminate the load supported by beam 262. Under such circumstances, the load supported by beam 262 is transferred to support beam 271, ropefalls 30 and 36 and the reeving system associated with such ropefalls. A loss of the load supported by beam 262 can also occur if there is a failure of a load supporting element of one or both of upper sheaves 18 or 20, one or both of lower sheaves 162 or 164, or hook assembly 186; in the event of any such failure the load supported by beam 262 is transferred to beam 271, ropefalls 30 and 36 and the reeving system associated with such ropefalls. The loss of the load supported by beam 262 results in a change in resistance in load cell 268 and a consequent generation of an electrical signal which activates brake mechanism 110 and thereby stops the rotation of lifting drum 14 and locks such lifting drum in place. Alternatively, the electrical signal generated by load cell 268 can be used to activate an alarm system in place of or in addition to the activation of brake mechanism 110.

Each of the outside ropefalls 30 and 36 are reeved in such a manner so that the load stresses on each of such ropefalls are substantially identical. Similarly, each of the inside ropefalls 32 and 34 are reeved in such a manner so that the load stresses on each of such ropefalls are substantially identical. The load stresses on ropefalls 30 and 36 can be the same or different than the load stresses on ropefalls 32 and 34. The inside ropefalls 32 and 34 and the outside ropefalls 30 and 36, and the reeving systems associated with each of such ropefalls are sized, designed and constructed in such a manner so that the entire load supported by hoist 10 can be supported by either outside ropefalls 30 and 36 and their associated reeving system, or inside ropefalls 32 and 34 and their associated reeving system. Failure of any one of the ropefalls 30, 32, 34 or 36, or both of the outside ropefalls 30 and 36, or both of the inside ropefalls 32 and 34, or a load supporting element of the reeving system associated with either outside ropefalls 30 and 36 or inside ropefalls 32 and 34, is automatically compensated for by the non-damaged ropefalls and the reeving system associated with such non-damaged ropefalls. The transfer of the entire load supported by hoist 10 to either the inside ropefalls 32 and 34 or the outside ropefalls 30 and 36 occurs without significant impact loading. Additionally, failure of one of the ropefalls 30, 32, 34 or 36, or both of the outside ropefalls 30 and 36 or both of the inside ropefalls 32 and 34, or a load supporting element of the reeving system associated with either outside ropefalls 30 and 36 or inside ropefalls 32 and 34, results in the assumption of the entire load by the non-damaged pair of outside ropefalls 30 and 36 or inside ropefalls 32 and 34 and the reeving system associated therewith, with very little, if any, swinging or twisting motion being imparted to the load due to the fact that outside ropefalls 30 and 36 and inside ropefalls 32 and 34 are reeved about a common load path.

Auxiliary hoist 56 which is a modified version of hoist 10 and embodies the present invention in a particular form comprises (FIGS. 1 to 3) lifting drum 300 and equalizer assembly 301, both of which are mounted on frame 48 of auxiliary trolley 46, and load block assembly 302 which is suspended from lifting drum 300 and equalizer assembly 301 by ropefalls 340, 342, 344 and 346, all as hereinafter further explained.

Lifting drum 300 is supported at one end by pillow block 303 and at the other end by pillow block 304. Pillow blocks 303 and 304 have bearing assemblies that permit the rotation of lifting drum 300. Pillow blocks 303 and 304 are mounted on cross beam 306 which forms a part of auxiliary trolley frame 48. The rotation of lifting drum 300 is powered by electric motor 308 which is mounted on mounting bracket 310 which in turn is mounted on auxiliary trolley floor section 312 which forms a part of auxiliary trolley 46. Electrically operated brake 314 is mounted on motor 308 and is adapted to engaging and stopping the rotation of the drive shaft of motor 308. Motor 308 is rotatably connected to gear reducer 316 by coupling 318. Gear reducer 316 is rotatably attached to shaft 320 of lifting drum 300 by coupling 322. Gear reducer 316 is mounted on cross beam 306. The rotation of the drive shaft of motor 308 transmits rotational motion to gear reducer 316 which in turn causes lifting drum 300 to rotate. The rotation of the drive shaft of motor 308 in one direction rotates lifting drum 300 in one direction, while the rotation of the drive shaft of motor 308 in the opposite direction rotates lifting drum 300 in the opposite direction. Brake 314 reduces or stops the rotation of the drive shaft of motor 308 and, consequently, the rotation of lifting drum 300. Brake 314 optionally locks lifting drum 300 in place during the transport of auxiliary crane loads.

A brake assembly, which is illustrated in FIG. 2 and is indicated generally by the reference numeral 330, is mounted on cross beam 306 and is adapted for stopping the rotation of lifting drum 300 in response to electrical signals from an auxiliary high speed sensor (described hereinafter) attached to lifting drum 300, a load sensor (described hereinafter) attached to auxiliary equalizer assembly 301, or by other suitable means. For example, brake mechanism 330 can be activated and controlled from a centrally located operator station by the operator of the crane with which trolley 12 and auxiliary trolley 46 are employed. Brake mechanism 330 is identical in design and construction to brake mechanism 110 with the exception that it is preferably smaller in scale due to the fact that lifting drum 300 is preferably smaller than lifting drum 14 and the loads for which lifting drum 300 is designed to handle are preferably smaller than the loads which lifting drum 14 is designed to handle. The above description of the parts, features and operation of brake mechanism 110 is sufficient for one of ordinary skill in the art to understand the design, construction and operation of brake mechanism 330.

High speed sensor 331 is mounted on pillow block 303 and is adapted for sensing the rotational rate of lifting drum 300. In the event the rotational rate of lifting drum 300 exceeds a predetermined level, sensor 331 generates an electrical signal which activates brake mechanism 330 and/or activates an alarm. Preferably, sensor 331 is set so as to generate such electrical signal in the event the rotational rate of lifting drum 300 exceeds by about 10% the maximum rotational rate intended for it. In the event brake mechanism 330 is activated, the rotation of lifting drum 300 is stopped.

Lifting drum 300 has a set of right-handed double grooves, indicated generally by the reference numeral 332, formed on its surface between the midportion of lifting drum 300 and the end of lifting drum 300 adjacent to pillow block 303. Lifting drum 300 also has a set of left-handed double grooves, indicated generally by the reference numeral 334, formed on its surface between the midpoint of lifting drum 300 and the end of lifting drum 300 adjacent to pillow block 304. Right-handed grooves 332 are adapted for coiling and uncoiling ropefalls 340 and 342. Left-handed grooves 334 are adapted for coiling and uncoiling ropefalls 344 and 346. One end of each of the ropefalls 340, 342, 344 and 346 is secured to lifting drum 300, while the other end of each of said ropefalls is secured to equalizer assembly 301, as hereinafter described.

Lower sheaves 350, 352, 354 and 356 are rotatably mounted on load block assembly 302. Each of the lower sheaves 350, 352, 354 and 356 have one sheave wheel and are coaxial to each other and positioned in a common horizontal plane. The sheave wheel of lower sheave 350 is rotatably mounted on and positioned between vertically extending parallel spaced plates 360 and 362. The sheave wheels of lower sheaves 352 and 354 are rotatably mounted on and positioned between vertically extending parallel spaced plates 364 and 366. The sheave wheel of lower sheave 356 is rotatably mounted on and positioned between vertically extending parallel spaced plates 368 and 370. Plates 360, 362, 368 and 370 are welded to hook block weldment 380. Plates 364 and 366 are mounted on hook block portion 382. Auxiliary hook 384 depends from auxiliary hook block assembly 302 and is secured to hook block weldment 380 and hook block portion 382.

Auxiliary equalizer assembly 301, which is best illustrated in FIG. 3, is pivotally mounted on mounting bracket 400 which in turn is mounted on cross beam 306. Equalizer assembly 301 has a trunnion, which is indicated generally by the reference numeral 402. Trunnion 402 has an upper straight trunnion section 404 and a lower U-shaped trunnion section 406. Trunnion 402 is seated on a pair of bushings (not shown in the drawings) and is secured to bracket 400 by bearing assemblies 408 and 410. Inner support member 412 is mounted on straight trunnion section 404 and extends downwardly to lower support beam 414. Lower support beam 414 is pivotally attached to support member 412 by pin 416. Support member 412 is secured to trunnion section 404 by nut 420. Donut-shaped load cell 422 is positioned between nut 420 and trunnion section 404. Outer support member 430 is mounted on trunnion section 406 and extends downwardly to upper support beam 432. Upper support beam 432 is pivotally attached to support member 430 by pin 434. Support member 430 is secured to trunnion section 406 by nut 436. Donut-shaped load cell 438 is positioned between nut 436 and trunnion section 406. Support members 412 and 430 are coaxially aligned with each other. Ropefalls 340 and 346 are pivotally attached to upper support beam 432 by pins 440 and 442, respectively. Ropefalls 342 and 344 are pivotally attached to lower support beam 414 by pins 444 and 446, respectively. Anti-twist plates 450 and 452 are welded to and depend from trunnion section 406 and are provided to prevent upper support beam 432 from twisting. Donut-shaped load cells 422 and 438 are prestressed in such a manner so that the resistance within such load cells is changed sufficiently to generate any electrical signal when the loads supported by lower support beam 414 and upper support beam 432, respectively, are varied above or below predetermined levels.

Ropefalls 340, 342, 344 and 346 are reeved as follows. Ropefall 340, which is coiled and uncoiled in grooves 332 of lifting drum 300, drops to sheave 350, wraps around the sheave wheel of sheave 350, and then extends upwardly to equalizer assembly 301 and is attached to support beam 432 by pin 440. Ropefall 342, which is coiled and uncoiled in grooves 332, drops to sheave 352, wraps around the wheel of sheave 352, and then extends upwardly to equalizer assembly 301 and is attached to support beam 414 by pin 444. Ropefall 344, which is coiled and uncoiled in grooves 334, drops to sheave 354, wraps around the wheel of sheave 354, and then extends upwardly to equalizer assembly 301 and is attached to support beam 414 by pin 446. Ropefall 346, which is coiled and uncoiled in grooves 334, drops to sheave 356, wraps around the wheel of sheave 356, and then extends upwardly to equalizer assembly 301 and is attached to support beam 432 by pin 442. The sections of ropefalls 340, 342, 344 and 346 extending between lifting drum 300 and load block assembly 302 are positioned in a substantially common plane (i.e., within normally acceptable design tolerances) with each other. Similarly, the sections of ropefalls 340, 342, 344 and 346 extending between load block assembly 302 and equalizer assembly 301 are positioned in a substantially common plane with each other. The rotation of lifting drum 300 in one direction coils ropefalls 340, 342, 344 and 346 resulting in a consequent shortening of such ropefalls and the lifting and load block assembly 302. The rotation of lifting drum 300 in the opposite direction uncoils ropefalls 340, 342, 344 and 346 resulting in a consequent lengthening of such ropefalls and the lowering of load block assembly 302.

In the event ropefall 340 or 346 breaks, the pivotal action of beam 432 causes sufficient slackening of the other of such ropefalls to eliminate the load supported by beam 432. Under such circumstances, the load supported by beam 432 is transferred to support beam 414, ropefalls 342 and 344 and the reeving system associated with such ropefalls. A loss of the load supported by beam 432 can also occur if there is a failure of a load supporting element of one or both lower sheaves 350 or 356; in the event of such failure the load supported by beam 432 is transferred to support beam 414, ropefalls 342 and 344, and the reeving system associated with such ropefalls. The loss of the load supported by beam 432 results in a change in the resistance within load cell 438 and a consequent generation of an electrical signal. The electrical signal generated by load cell 438 activates brake mechanism 330 and thereby stops the rotation of lifting drum 300. Alternatively, the electrical signal generated by load cell 438 can be used to activate an alarm system in place of or in addition to activating brake mechanism 330.

In the event ropefall 342 or 344 breaks, the pivotal action of beam 414 causes sufficient slackening of the other of such ropefalls to eliminate the load supported by beam 414. Under such circumstances, the load supported by beam 414 is transferred to support beam 432, ropefalls 340 and 346, and the reeving system associated with such ropefalls. A loss of the load supported by beam 414 can also occur if there is a failure of a load supporting element of one or both lower sheaves 352 or 354; in the event of such failure the load supported by beam 414 is transferred to support beam 432, ropefalls 340 and 346 and the reeving system associated with such ropefalls. The loss of the load supported by beam 414 results in a change in resistance in load cell 422 and a consequent generation of an electrical signal which activates brake mechanism 330 and thereby stops the rotation of lifting drum 300. Alternatively, the electrical signal generated by load cell 422 can be used to activate an alarm system in place of or in addition to the activation of brake mechanism 330.

Each of the outside ropefalls 340 and 346 are reeved in such a manner so that the load stresses on each of such ropefalls are substantially identical. Similarly, each of the inside ropefalls 342 and 344 are reeved in such a manner so that the load stresses on each of such ropefalls are substantially identical. The load stresses on ropefalls 340 and 346 can be different than the load stresses on ropefalls 342 and 344. The inside ropefalls 342 and 344, and the outside ropefalls 340 and 346, and the reeving systems associated with each of such ropefalls are sized, designed and constructed in such a manner so that the entire load supported by auxiliary hoist 56 can be supported by either outside ropefalls 340 and 346 and their associated reeving system, or inside ropefalls 342 and 344 and their associated reeving system. Failure of any one of the ropefalls 340, 342, 344 or 346, or both of the outside ropefalls 340 and 346, or both of the inside ropefalls 342 and 344, or a load supporting element of the reeving system associated with either outside ropefalls 340 and 346 or inside ropefalls 342 and 344, is automatically compensated for by the nondamaged ropefalls and the reeving system associated with such nondamaged ropefalls. The transfer of the entire load supported by auxiliary hoist 56 to either the inside ropefalls 342 and 344 or outside ropefalls 340 and 346 occurs without significant impact loading. Additionally, failure of one of the ropefalls 340, 342, 344 or 346, or both of the outside ropefalls 340 and 346 or both of the inside ropefalls 342 and 344, or a load supporting element of the reeving system associated with either outside ropefalls 340 and 346 or inside ropefalls 342 and 344, results in the assumption of the entire load by the non-damaged pair of outside ropefalls 340 and 346 or inside ropefalls 342 and 344 and the reeving system associated therewith, with very little, if any, swinging or twisting motion being imparted to the load due to the fact that outside ropefalls 340 and 346 and inside ropefalls 342 and 344 are reeved about a common load path.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

I claim:

1. A hoist with redundant safety features comprising:

a hoist support frame;

lifting drum means mounted on said hoist support frame;

means for rotating said lifting drum means;

brake means for stopping the rotation of said lifting drum means;

load block assembly means;

equalizer assembly means mounted on said hoist support frame;

a first set of ropefalls and a second set of ropefalls; and an alarm;

said load block assembly means being suspended by said first set of ropefalls and said second set of ropefalls, each of said ropefalls having one end secured to said lifting drum means and the other end secured to said equalizer assembly means, each of said sets of ropefalls having sufficient load bearing capacity to carry the load carried by the other set of ropefalls in addition to its own load; each of said ropefalls having first sections extending from said lifting drum means to said load block assembly means and second sections extending from said load block assembly means to said equalizer assembly means, each of said first sections being positioned in a substantially common plane with each other, and each of said second sections being positioned in another substantially common plane with each other;

said equalizer assembly means including first means for balancing the load carried by said first set of ropefalls, second means for balancing the load carried by said second set of ropefalls, and load sensor means for generating an electrical signal in response to variations in the load carried by said first or said second set of ropefalls, said electrical signal being adapted for activating said brake means and/or activating said alarm, said equalizer assembly including equalizer support means mounted on said hoist support frame, said first means for balancing the load comprising a first ropefall support member pivotally mounted on said equalizer support means, the other ends of the ropefalls of said first set of ropefalls being secured to said first ropefall support member, said second means for balancing the load comprising a second ropefall support member pivotally mounted on said equalizer support means, the other ends of the ropefalls of said second set of ropefalls being secured to said second ropefall support member, said load sensor means comprising a first load sensor mounted on said equalizer support means adapted to sense the load carried by said first ropefall support member and to generate said electrical signal when said load carried by said first ropefall support member is varied beyond a predetermined level, and a second load sensor mounted on said equalizer support means adapted to sense the load carried by said second ropefall support member and to generate said electrical signal when said load carried by said second ropefall support member is varied beyond a predetermined level, said equalizer support means comprising trunnion means pivotally mounted on said hoist support frame; an inner support member mounted on said trunnion means and extending downwardly from said trunnion means, said second ropefall support member comprising a second support beam pivotally depending from said inner support member; an outer support member mounted on said trunnion means and extending coaxially with said inner support member downwardly from said trunnion means, said first ropefall support member comprising a first support beam pivotally depending from said outer support member; the other ends of the ropefalls of said first set of ropefalls being secured to said first support beam, the other ends of the ropefalls of said second set of ropefalls being secured to said second support beam.

2. The hoist of claim 1 wherein said equalizer support means includes anti-twist means depending from said trunnion means.

3. A crane comprising a bridge with the hoist of any one of claims 1 or 2 mounted on said bridge.

4. A crane trolley comprising a trolley frame with the hoist of any one of claims 1 or 2 mounted on said trolley frame.

* * * * *